United States Patent [19]

Minghenelli

[11] 4,196,741

[45] Apr. 8, 1980

[54] PRODUCT AND PROCESS FOR HIGHLIGHTING AND STREAKING HAIR

[76] Inventor: Santo M. Minghenelli, 4121 Levick St., Philadelphia, Pa. 19135

[21] Appl. No.: 816,366

[22] Filed: Jul. 18, 1977

[51] Int. Cl.[2] ..... A45D 1/00

[52] U.S. Cl. ..... 132/9

[58] Field of Search ..... 132/9, 40, 42, 43 R, 132/7, 53

[56] References Cited

U.S. PATENT DOCUMENTS

| | | | |
|---|---|---|---|
| 851,384 | 4/1907 | Sleicher | 132/53 |
| 1,812,442 | 6/1931 | Lewis | 132/7 |
| 2,720,207 | 10/1955 | Burtnett | 132/43 R |
| 3,068,874 | 12/1962 | Rapisarda | 132/9 |
| 3,546,336 | 12/1970 | Jones | 132/7 |
| 3,546,336 | 12/1970 | Jones et al. | 132/7 |
| 3,560,610 | 2/1971 | Korden | 132/7 |
| 3,692,032 | 9/1972 | Regas | 132/9 |
| 3,871,388 | 3/1975 | Leoci | 132/9 |

*Primary Examiner*—G. E. McNeill
*Attorney, Agent, or Firm*—Eugene E. Renz, Jr.

[57] ABSTRACT

Liquid-impermeable sheets, suitably composed of aluminum foil, are provided with a coating of pressure-sensitive adhesive, preferably adjacent one edge of the sheet, and optionally, a strippable cover to protect the adhesive prior to use. The process comprises separating a portion of hair to be treated from the remaining hair on the head, adhering one of the liquid-impermeable sheets to the scalp and hair of the head immediately adjacent and below the roots of the portion of hair to be treated, and treating the selected portion of hair with any desired liquid-treating agent such as a bleach or dye and permitting the treated hair to overlie the central portion of the liquid-impermeable sheet while the treating agent takes effect and, optionally, folding or rolling the sheet toward the head and then folding the edges inwardly to form an envelope, thus isolating the treating agent from the remainder of the head of hair and treating only the selected portion of hair.

9 Claims, 6 Drawing Figures

PRODUCT AND PROCESS FOR HIGHLIGHTING AND STREAKING HAIR

BACKGROUND OF THE INVENTION

In recent years it has become fashionable to highlight and streak the hair to add interest and attractiveness. While this practice might seem simple of accomplishment to the laymen, professional hair colorists and those individuals who have attempted to streak or highlight their own hair or that of another realize that considerable skill and technique is necessary to obtain even a passable job and that ruly professional results are very difficult of achievement. For this reason many techniques have been developed for highlighting and streaking hair which have various advantages and disadvantages and provide varying degrees of sucess, depending upon the skill of the operator and other factors.

THE PRIOR ART

The apparently simplest method of bleaching or coloring hair to achieve a contrasting color is hair painting. In this method the person or operator simply applies a bleach or dye directly to the head of hair in the desired area to add the desired highlight or color. In this method it is generally desired to color or bleach only the uppermost strands of hair. However, the liquid dye or bleach tends to penetrate the entire depth of the hair and, therefore, to reach underlying hair which is not desired to treat. Therefore, while hair painting is seemingly simple, it is in fact a very difficult method to control and requires a highly skilled colorist to achieve the desired result.

In an attempt to achieve greater control of the coloring or bleaching process it has been suggested to borrow a technique from the pastry chefs, i.e. to use a pastry bag and a thick coloring or bleaching agent. In this way the colorist is able to apply elongated beads of color or bleach to the desired strands of hair. This has the definite advantages of greater control of application than is possible using a brush and a thin liquid as in the painting method. Moreover, the color being in a thick bead does not run and penetrate the body of the head of hair as with the painting method. The pastry bag also has the advantage that the color flows smoothly and continuously from the tip of the bag in response to the squeezing of the bag or the operator and there is no need to repeatedly dip a paint brush with the attendant possibility dripping or splashing color where it is not wanted. However, inasmuch as the color or bleach is applied directly to the hair to be colored without physical separation of that hair from adjacent hair not to be colored, there is still the possibility of bleeding or contact coloring of the hair not to be treated. Therefore, while this method is superior to painting it is not the ultimate solution to the problem of contrast coloring of hair.

The use of specially designed cups for coloring hair has been suggested to aid in isolating the hair to be treated from hair not to be treated. These cups consist of a base member having a slit for receiving hair. A portion of the hair to be colored is first woven by known technique and inserted in the slit of a cup base. The base is then positioned as close to the person's scalp as possible by tensioning the woven hair with one hand and pushing the base against the head with the other hand. It has been found necessary to wet the hair before applying the cup bases in order to provide enough friction in the slit to hold the base in place on the hair. The woven hair protruding from the cup base is then wound up and placed in a cup which is then press-fitted onto the base. This procedure is repeated until all of the portions of hair to be treated are enclosed in the cups. As the procedure is carried out the hair in the cups tends to dry and this permits the cups to slide away from the head due to insufficient friction. The operator must, therefore, continually retension the hair in the cups as necessary. The dye or bleach is then introduced to the cups and allowed to take effect for as long as necessary to achieve the desired contrast. This method is an improvement over those described above in that it segregrates the hair to be treated from the hair wet to be treated. The cup method is, however, subject to a number of disadvantages. One problem is that no matter how carefully the cup bases are applied and tension maintained on the hair to keep them in place, the cup bases still occupy about ¼" of space on the hair adjacent the scalp which, therefore, is not treated by the dye or bleach. Also the fact that the hair must be wet in order to hold the cups in place is a disadvantage since the water in the hair dilutes the bleach or color thus reducing its effectiveness. Also this method is useable only with certain commercial bleach and coloring products which have a high enough viscosity to remain in the cups without leaking out during treatment. Moreover, inasmuch as the cups are about 1" in diameter, the portions of hair treated must be at least 1" apart and this limits the effects which may be achieved. Here again, this method requires a skillful operator to manipulate a plurality of cups and minimize the untreated area at the roots of the hair. This method also fails to provide any means for touching up new growth at the roots of the hair without affecting the remainder of the strands of previously treated hair.

Cap frosting has probably been the method most used in the prior art for imparting contrasting color to the hair. In this method the hair is first shampooed and allowed to dry. The head is then covered with wax paper held in place by suitable means, and then a closely fitting fabric cap is pulled over the head. The hair is normally brushed from front to back before the wax paper and cap are applied. The cap is provided with a plurality of small holes through which the operator inserts a crotchet hook to puncture the wax paper and hook and pull a bundle of strands of hair through the wax paper and hole in the cap. This procedure is repeated as often as necessary to achieve the desired effect, e.g. 60 to 100 times. The hair thus exposed and isolated from the hair under the cap and wax paper is then treated with bleach or dye and allowed to process. After the proper period of time the cap and wax paper are removed and the entire head is again shampooed to remove the bleach. The frosting is then completed by applying a toner according to conventional methods. While this method is among the best of the prior art, it is still subject to many disadvantages. First of all, inasmuch as the hair is first all combed back from front to back, there is a substantial depth of hair under the cap which holds the cap away from the scalp somewhat and makes it difficult to treat the roots of the hair. Also hair underlying the hair on top may come from a different area of the head than that above. This coupled with the fact that the operator can not see through the cap makes it difficult to control exactly what portion of hair is being treated. It also requires much skill and care to insert the crochet needles without injuring the person's scalp. For these reasons, the method does not treat the ¼" of hair adjacent the scalp and tends to produce a blotchy effect due to running and spotting of the bleach through the holes in the cap and wax paper. For this reason, it is almost invariably necessary to use a toner to smooth out the uneven, blotchy bleach job obtained. It should also be noted that hair from different areas of the head takes the bleach differently so that it is difficult to make the necessary adjustments to obtain a smoothly colored effect when hair from different areas is obtained in one bundle of strands pulled through the cap. Also when hair is treated for the second or successive times by this method, it is impossible not to mix and treat previously treated and previously untreated hair. This results in over bleaching and damage to some hair.

An excellent but very difficult technique of the prior art is the basic foil method in which a sheet of aluminum foil is held under the hair to be treated. The hair to be treated or colored is first woven by well-known techniques and then a sheet of aluminum foil is held against the scalp and other hair of the head with the edge of the foil as closely adjacent the roots of the hair to be treated as possible. The desired bleach, dye or other product is then applied to the hair so-isolated. The lower free end of the aluminum foil is folded or rolled toward the head until out of the way of the next portion of hair to be treated. The sides are then folded inwardly to form a crimped envelope or package completely enclosing the treated hair. The hair is allowed to process for the required period of time and then the foil package is removed. Normally, the plurality of portions of hair are treated in this manner and this aggravates the problem of holding the foil in place, both during application of the treating agent and during processing. This requires great care and more than one pair of hands so that an assistant must be employed to do the tedious and exacting job of holding a plurality of foils in place. Any movement of the person's head or slip by the operator or assistant leads to spotting or bleaching where it is not wanted. The problem becomes even more critical when the person is placed under a hair dryer, for any movement may cause one or more of the foil packages to slip and ruin the desired effect. While this method can provide excellent results and close bleaching at the root of the hair, it is very difficult to perform properly. Also, it is expensive in requiring the time of an assistant to cut the sheets of foil and hold them in place.

It has also been proposed to carry out the basic foil method described above substituting "Saran" wrap transparent plastic sheeting for the aluminum foil. This method is even more difficult to perform because the plastic wrap does not cling to itself as the foil does and is even more difficult to keep in place. Also the platic wrap is slippery, particularly when wet with treating agent, so that hair does not stay in position well on the sheet. Also, the weight of the plastic itself tends to cause it to slip off of the treated hair. It has been proposed to use rods or clip means with "Saran" plastic wrap to overcome the foregoing disadvantages, but these fasteners have the disadvantage of taking up space and preventing treatment of the ¼" of hair adjacent the scalp. Moreover, the rods and clamps get in the way just as the cups do, thus limiting the achievement of desirable effects.

It will be apparent from the foregoing that while the prior art has suggested many methods of achieving color contrast of the hair, no really satisfactory method for this purpose has previously been known.

It is an object of the present invention, therefore, to provide a simple, economical, effective method for providing color contrast to the hair, which is capable of treating the roots of the hair as well as the body thereof, and which requires only ordinary skill by the operator.

It is another object of the invention to provide an improvement in the basic foil method of contrast coloring of hair which eliminates the need for an assistant operator and which also provides security against poor results due to slippage or movement of the foil.

It is still another object of the invention to provide a new hair coloring product in the form of adhesive liquid-impermeable sheets for use in the contrast coloring of hair.

It is another object of the invention to provide adhesive liquid-impermeable sheets for use in contrast coloring hair which are pre-coated with a relatively dry hair treating agent which on application of s suitable liquid are activated to effective hair treating condition.

SUMMARY OF THE INVENTION

The foregoing and other objects of the present invention which will become apparent hereinafter are achieved by providing an improvement in the basic foil method for contrast coloring of hair and articles useful in that method. In their simplest form the new articles comprise a liquid-impermeable sheet with adhesive means for attaching the sheet firmly but releaseably to the scalp and hair of a person's head immediately adjacent the roots of a portion of hair to be bleached or colored. The adhesive may be coated directly on the liquid-impermeable sheet or may be supplied by adhering a double coated adhesive tape to the sheet so that one side of the tape is very securely fixed to the sheet and the other side exposes adhesive for adhering the sheet to the hair and scalp.

Any suitable commercially available, pressure-sensitive adhesive may be used in the present invention, the principal requirements being that the adhesive be firmly but releaseably adherent to the hair and scalp, wet or dry, and that the adhesive have greater adherance to the liquid-impermeable sheet than it does to the hair and scalp. This is necessary so that the adhesive will adhere to the liquid-impermeable sheet rather than to the hair and scalp when the sheet is removed from the person's head after use.

The adhesive per se or the double coated adhesive tape is applied to the liquid-impermeable sheet inwardly of the edges of the sheet other than the edge thereof to be adhered to the hair and scalp adjacent the roots of the hair to be treated. While the adhesive may be located in any central area of the sheet, it is preferred that the adhesive area extend to one edge of the sheet, i.e. to the edge to be placed at the root of the hair to be treated. The other edges of the sheet are preferably left free of adhesive for a suitable space to facilitate inward folding of those edges in making a folded package to enclose the hair to be treated.

Any exposed adhesive on the liquid-impermeable sheets, whether adhesive per se or double coated adhesive tape, is preferably protected prior to use with a strippable cover. Such a cover precludes the sticking together of a plurality of sheets in a package or stack prior to use and facilitates handling in other ways. The cover preferably extends beyond the adhesive area in at least one place, e.g. at the end of an adhesive strip, so as to provide a non-adhered tab which may readily be grasped to facilitate removal of the protective cover prior to use of this sheet.

The liquid-impermeable sheets may be composed of any suitable material impermeable and chemically inert to the treating agents to be applied to the hair. Metal foils, and especially aluminum foil, are preferred as the liquid-impermeable sheets because of their excellent working qualities in the basic foil contrast coloring method. More specifically, metal foils, and the preferred aluminum foil are desirable not only because they are liquid-impermeable and inert under the processing conditions, but because they can be crimped together so as to hold their configurations in a folded package around the treated hair. A material which is resilient such as some plastic foils, is less desirable, unless it is also self-adherent because such a folded package will tend to unwrap itself. The aluminum foil may be of any suitable type or thickness, but it has been found that so-called "institutional aluminum foil" is especially suitable. The aluminum foil may be from about 0.0003" to about 0.0010" in thickness, a thickness of about 0.0007" being especially suitable. While foils less than about 0.0003" thick may be employed they tend to tear and not have the required durability in use. On the other hand, while foils thicker than 0.0010" could be used, they are unnecessarily heavy for the purpose and, therefore, less economical.

In one preferred embodiment of the invention a rectangular sheet of 0.0007" aluminum foil about 5" by 6" is coated with a suitable adhesive along the 5" edge on one side, the coating reaching to the edge of the foil but not extending all the way to the perpendicular 6" sides of the sheet. An area adjacent each 6" side at that edge, perhaps ½" to 1" or more is left free of adhesive. This prevents tearing of the foil, adjacent the adhesive coating when the sheet is adhered to the head and the edges folded inwardly. The adhesive strip along the 5" edge may be of any suitable width sufficient to provide firm but releaseable adhesion to the scalp and hair. This may be as little as ¼' wide with some adhesives, but about ½" is generally more satisfactory. Even wider adhesive strips may be used, but this, of course, somewhat limits the spacing of foils on the person's head and, therefore, the coloring effect or amount of hair treated at one time.

In the method of the invention, such liquid-impermeable sheets are adhered to the hair and scalp at the root of the hair, to be treated and color or bleach is applied with a brush, or otherwise. The lower, free end of the sheet is then folded or rolled toward the adhered edge of the sheet until the folded or rolled size of the sheet is reduced enough to permit access to the next portion of hair to be treated. The sides or lateral ends of the rolled or folded sheet are then folded inwardly to complete the package or envelope around the hair. The process is then repeated using additional sheets as desired until all the hair to be colored or bleached is encapsulated. Sufficient time is permitted to elapse for proper processing and the packages are unfolded and removed, generally in the reverse order in which they were applied.

In another embodiment of the invention a similar sheet may be coated on the surface not coated with adhesive, with a hair treating agent. This agent may be in any suitable form which will adhere to the sheet while it is being applied to a person's head. For example, the treating agent may be applied to the sheet and dried thereon in any suitable composition, such as a gel for example. Such a coating of treating agent may be activated prior to use by the application of a suitable activating liquid, either before or after placing the hair to be treated over the coated surface. The coating of treating agent, of course, should cover the entire area of the sheet on which hair will lie, the folding edges being preferably left free of treating agent.

BRIEF DESCRIPTION OF THE DRAWINGS

The invention will now be described in greater detail in conjunction with the accompanying drawings in which.

DETAILED DESCRIPTION OF THE INVENTION

Figure 1:
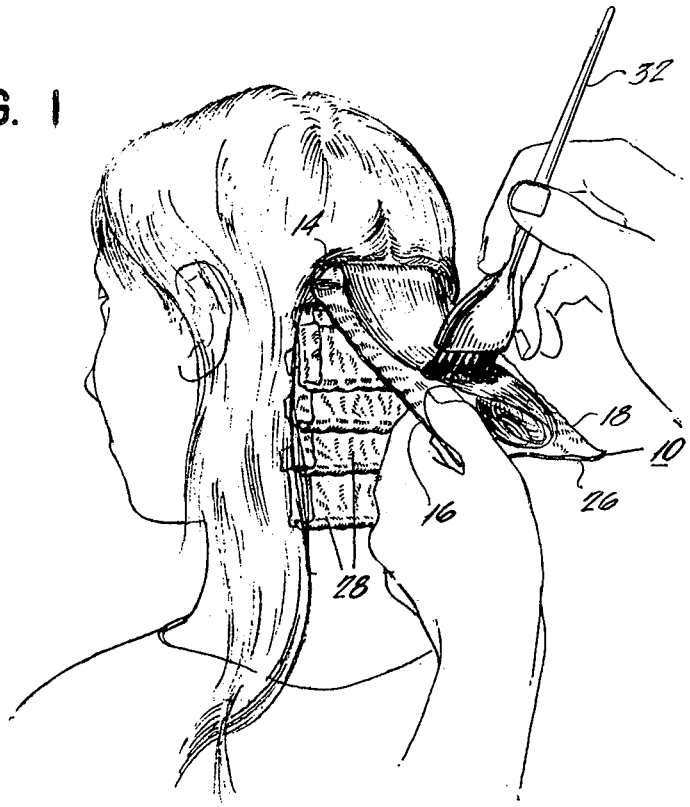
FIG. 1 is a rear view of a person's head showing a plurality of folded sheets of the invention in place, and the application of a hair treating agent using another such sheet.
Figure 2:
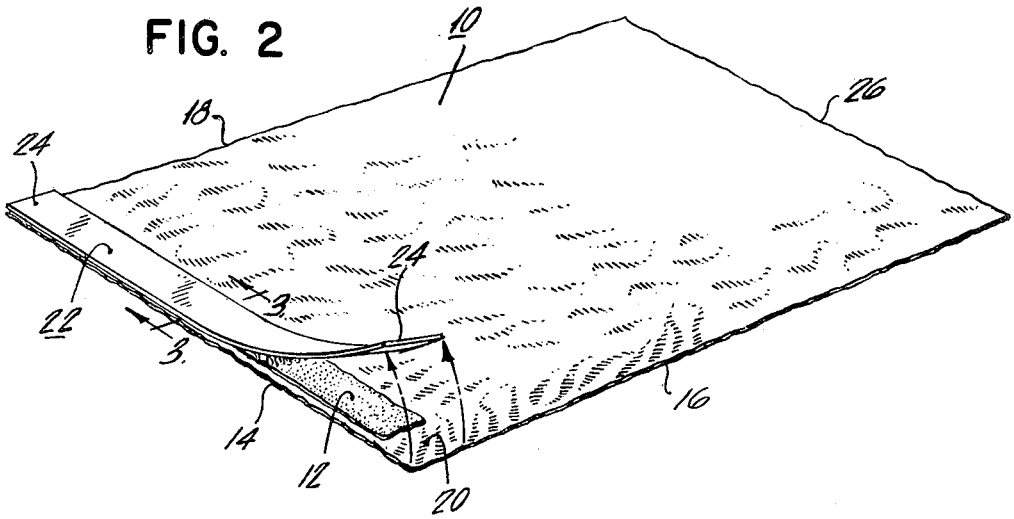
FIG. 2 is a perspective view looking down upon the upper surface of a liquid-impermeable sheet of the invention showing a coating of adhesive adjacent one edge and a strippable cover thereon.

A preferred embodiment of the invention, as shown in FIG. 2, comprises a liquid-impermeable sheet of aluminum foil 10, about 5"×6", having a coating of a suitable pressure-sensitive adhesive 12 adjacent one of the shorter 5" edges 14 thereof. The coating 12 may be spaced slightly from the edge 14 as shown, if desired, but is preferably extended all the way to edge 14 in order to facilitate close placement of the sheet at the roots of the hair. The adhesive 12 is applied in an area about ½" wide terminating about ½" or more short of the 6" sides 16 and 18 of the sheet. This leaves areas 20 at either end of the adhesive coated area which are free of adhesive. A strippable cover 22 is adhered to the adhesive area to protect the adhesive 12 prior to use. The end 24 of the cover 22 which does not adhere to area 20 forms a tab to facilitate removal of the cover 22 prior to use of the sheet.

Figure 3:
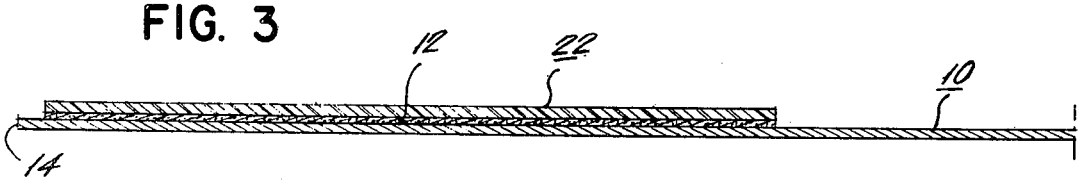
FIG. 3 is an enlarged cross sectional view of the sheet of FIG. 2 taken on the live 3—3.

In FIG. 3, the aluminum sheet 10, adhesive layer 12, cover 22 and edge 14 are seen in cross section on a much enlarged scale.

Figure 4:
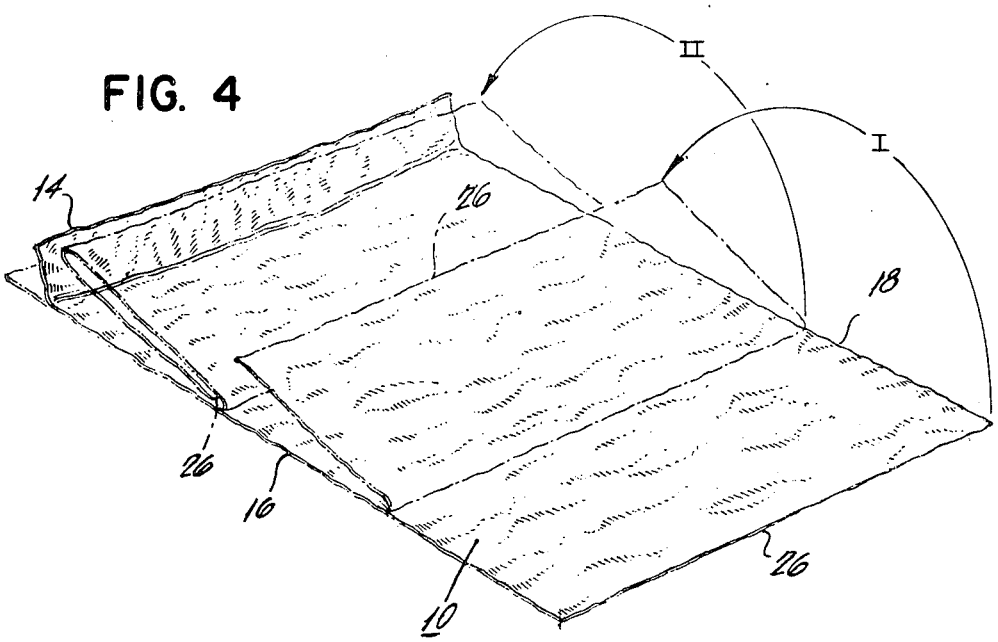
FIG. 4 is a perspective view looking down upon the upper surface of a liquid-impermeable sheet such as that of FIG. 2, showing the method of folding the sheet toward the adhesive coated edge.

One method of folding the liquid-impermeable sheets of FIGS. 2 and 3 is shown in FIG. 4 where the free short edge of the sheet 26 is folded toward the opposite adhesive-coated edge 14 through an arc I, after a bundle of hair, not shown, overlying the sheet 10 has been treated. The single fold made in this way may, as shown, constitute about one-third, i.e. 2" of the 6" length of the sheet, not counting the adhesive area adhered to a person's head. This first fold is then folded again in the same direction through arc II to form a double fold, i.e. three thicknesses of aluminum foil enclosing treated hair.

Figure 5:
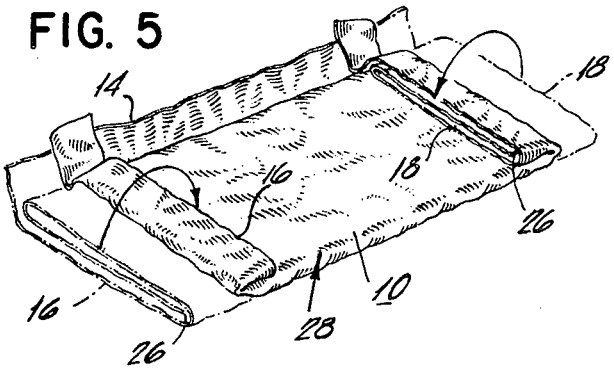
FIG. 5 is a perspective view of the folded sheet of FIG. 4 showing how the side edges thereof are folded inwardly to make a closed package.

In FIG. 5, the envelope around the hair is completed by folding the now triple thickness edges 16 and 18 inwardly and crimping them to seal the package 28 formed in this way. Four such packages 28 are shown in place on a person's head, while a fifth as yet unfolded sheet 10 is being used to isolate and treat another bundle of hair by means of a treating agent, bleach or dye on the brush 32.

Figure 6:
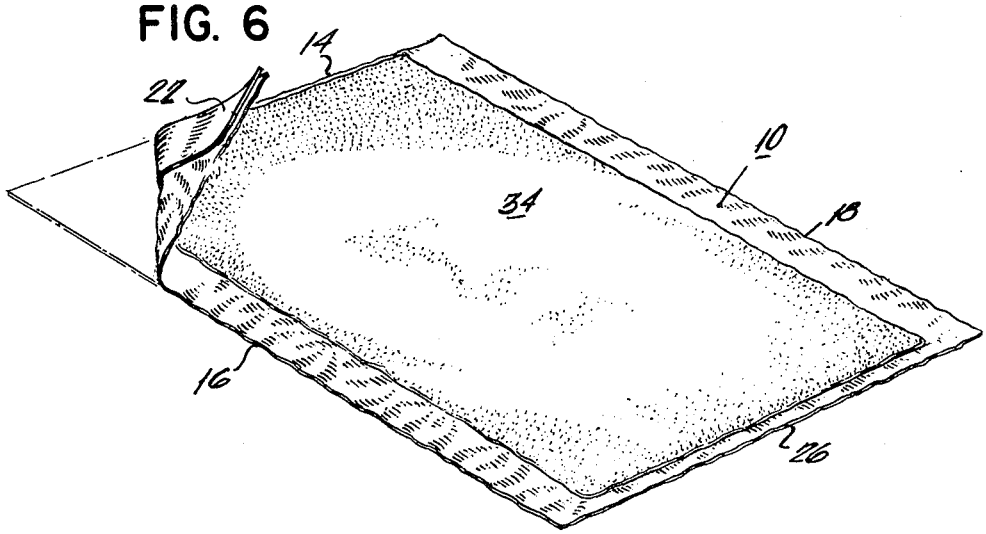
FIG. 6 is a perspective view of another embodiment of the invention showing a coating of hair treating agent on the liquid-impermeable sheet.

In another preferred embodiment of the invention shown in FIG. 6, a liquid-impermeable sheet of aluminum 10 is coated on the surface opposite the adhesive, with a hair treating agent 34. This agent may be of any suitable type that can be adhered per se, or in a suitable composition, to the sheet 10. The agent 34 is preferably dry or relatively drum such as a gel, for example, so that it does not flow or leak in a package of such sheets. Such a dry hair treating agent composition is activated prior to use by the application of a suitable liquid, either before or after placing the hair to be treated on the sheet 10 above the activated agent 34. This sheet 10 is also provided with a strippable cover and an underlying adhesive area along the edge, and is folded or rolled up in the same way as the sheets of FIGS. 1 through 5.

As noted previously any of the pressure-sensitive skin-adherent adhesives known to the art are suitable such as those widely used on surgical tapes. More specifically, an especially suitable adhesive is one used on and available in the form of "MED-3044 Double-Coated Medical Tape" from the Fasson division of Avery Products Corporation. This tape, is suitable for use in the embodiments of the invention utilizing a double coated tape adhered to a liquid-impermeable sheet. This tape consists of 0.003" polyethylene, coated on both sides with a non-sensitizing acrylic adhesive protected by a white polyethylene coated release paper and is intended for use with any device to be firmly fixed to the body. The tape is soft and comfortable yet of high strength, has good initial tack and excellent skin adhesion, leaves no residue on removal and is non-sensitizing to the skin. The adhesive coatings have a total thickness of 0.004", i.e. 0.002" per side. The adhesion is about 25–45 oz./inch of width of the tape to polyethylene. The Polyken Tack, i.e. 2 cm/sec., 2 seconds, 100 gms/cm$^2$ is about 700–1000 gms.

It will be seen from the foregoing that the articles and method of the present invention provide for the first time, a reliable, effective means for contrast coloring of hair even by relatively unskilled operators. Of course, skill is still required to achieve an artistic or aesthetic effect but the present invention has largely obviated the need for superior manipulative or maechanical technique. This is due to the fact that the possibility and indeed previous probability of movement or slippage of the foil has been eliminated. Moreover, the new method and articles are far more economical than previous methods since the need for an assistant to cut sheets of foil and hold them in place is entirely eliminated. The coloring or bleaching achieved by the new method and articles extends smoothly and evenly from the very roots of the hair to the ends of the hair without blotchiness or spotting of adjacent hair due to the perfect isolation of the hair to be treated, thus, achieving the objects of the invention.

What is claimed is:

1. A liquid-impermeable imperforate sheet adapted to be removably secured to the scalp so that one edge is positioned closely adjacent the roots of selected strands of hair to be colored or bleached, a pressure-sensitive adhesive along only said one edge capable of adhering firmly but releasably to skin and hair and having substantially greater adhesion to said sheet, said sheet being of a thin, flexible metallic material capable of being folded and crimped to form a self supporting compact enclosure for said strands of hair to be treated, said enclosure retaining its folded configuration due to the crimping of said sheet by application of pressure alone.

2. A liquid-impermeable sheet of claim 1 wherein the coating of pressure-sensitive adhesive is provided by application to said sheet of an element comprising an intermediate backing coated on both sides with said pressure-sensitive adhesive.

3. A liquid-impermeable sheet of claim 1 wherein the adhesive coating not adhered to the liquid-impermeable sheet is protected prior to use by a strippable cover.

4. A liquid-impermeable sheet of claim 3 wherein the strippable cover extends beyond the adhesive area to provide a non-adhered tab to facilitate removal of said cover.

5. A liquid-impermeable sheet of claim 1 wherein the sheet is composed of aluminum foil.

6. A liquid-impermeable sheet of claim 1 having on the surface thereof opposite the adhesive coated surface, a coating of a hair treating agent, said coating of hair treating agent extending over the major portion of said surface except for uncoated areas adjacent those edges of said sheet other than the edge having the adhesive coating on the other side which edge is coated with said treating agent.

7. A liquid-impermeable sheet of claim 6 wherein said treating agent is in the form of a relatively dry gel activatable by application of a liquid to become an active hair treating agent.

8. A liquid-impermeable sheet of claim 1 wherein said adhesive area adjacent one edge of said sheet is spaced inwardly from the ends of said edge leaving adhesive-free sides on said sheet.

9. A liquid impermeable sheet of claim 8 including a strippable cover overlying said adhesive and extending beyond said area to provide a free tab for removal thereof.

* * * * *